United States Patent [19]

Sample

[11] Patent Number: 4,474,218

[45] Date of Patent: Oct. 2, 1984

[54] PICK FINDER APPARATUS FOR FLUID JET LOOMS

[75] Inventor: Randell F. Sample, Greensboro, N.C.

[73] Assignee: Draper Corporation, Greensboro, N.C.

[21] Appl. No.: 443,503

[22] Filed: Nov. 22, 1982

[51] Int. Cl.[3] ..... D03D 51/08

[52] U.S. Cl. ..... 139/1 E; 139/336; 192/67 R

[58] Field of Search ..... 139/1 E, 1 R, 336, 66 R; 192/67 R, 89 R, 101; 74/812, 126

[56] References Cited

U.S. PATENT DOCUMENTS

| | | | |
|---|---|---|---|
| 1,802,820 | 4/1931 | Lindsjo | 139/1 E |
| 1,907,619 | 5/1933 | Graf et al. | 192/67 R |
| 3,237,648 | 3/1966 | Grisay | 139/1 E |
| 3,875,972 | 4/1975 | Duprey | 139/1 E |

FOREIGN PATENT DOCUMENTS

| | | | |
|---|---|---|---|
| 1061940 | 3/1967 | United Kingdom | 139/1 E |
| 427107 | 11/1974 | U.S.S.R. | 139/1 E |

*Primary Examiner*—James Kee Chi

*Attorney, Agent, or Firm*—Charles R. Rhodes; Judith E. Garmon

[57] ABSTRACT

The cam shaft of a fluid jet loom, which cam shaft normally operates the warp yarn harness frames, is disengaged from the machine drive mechanism by a clutch mechanism. The cam shaft is then rotated manually by the operator, as the machine drive is by-passed, to reposition the harness frames at a proper position such that faulty picks can be easily removed.

4 Claims, 5 Drawing Figures

PICK FINDER APPARATUS FOR FLUID JET LOOMS

BACKGROUND OF THE INVENTION

The removal of faulty picks has always been at least a minor problem which must be dealt with by loom operators during the weaving operation. Faulty picks occur in all types of weaving operations, whether the loom be a conventional fly shuttle loom, a more recent shuttleless loom, or one of the most recent fluid jet looms. For various reasons, the weft or filler yarn is not always carried through the sheds of warp yarns consistently during each pick of the weaving machine. For a number of years, it has been conventional to provide weaving machines with automatic stopping attachments whereby when a faulty pick occurs, the machine is automatically shut down.

It is then necessary to reverse the shedding mechanism (operation of the warp yarn harness frames) in order for the operator to gain access to the faulty pick to effect its removal. In the case of fly shuttle looms or shuttleless looms, this operation is fairly simple in that the machine can be hand picked (operation in which the shuttle is sent back between sheds) one cycle at a time back to the proper point for easy removal. The hand picking operation will simultaneously properly reverse the operation of the warp yarn harness frames.

In the case of fluid jet looms, however, such hand picking operation cannot be effected. As a result, it is necessary to manually rotate the cam shaft which operates the warp yarn harness frames to reverse the warp yarns in the shed in order to gain access to the faulty pick. The present invention then is directed to the apparatus which allows the operator to perform this operation on a fluid jet loom or on a fly shuttle loom that has been converted to a fluid jet loom.

SUMMARY OF THE PRESENT INVENTION

The present invention then is hereinafter referred to as a pick finder apparatus for fluid jet looms of the type in which the warp yarns frames are operated by a cam shaft which in turn is operatively connected to the loom drive mechanism. Toward this end a clutch means is positioned in the drive chain between the loom drive mechanism and the cam shaft for selectively disengaging the cam shaft from the loom drive during machine stoppages. There is further provided a manually operable means for by-passing the loom drive mechanism to rotate the cam shaft thereby repositioning the warp yarn harness frames to such a point that the shed opens up and releases the faulty pick so that it can be removed.

The clutch means includes a first member or gear hub which is mounted on the cam shaft in such a manner that it is fixed in an axial direction, but the cam shaft is free to rotate within the gear hub. The gear hub further includes a toothed periphery operably engaged by the drive mechanism of the loom for imparting rotation to the gear hub during normal operation. One end of the gear hub is provided with a clutch face arranged concentrically around the cam shaft.

Also mounted on the cam shaft and a part of the clutch means is a second clutch member which is slidable along the cam shaft in an axial direction but keyed to the shaft in such a manner that relative rotation between the second clutch member and the shaft is prevented. The second clutch member has a meshing face configuration to the clutch face on the first member so that when it is positioned in abutting relation to the first member or gear hub, the driving force from the drive mechanism is transmitted through the gear hub to the clutch member and to the cam shaft for rotation of the shaft.

A spring normally biases the second clutch member into operative or abutting engagement with the gear hub; however, a lever arm is connected to the second clutch member so that when the machine is stopped, and the lever is lifted, the second clutch member is moved axially along the cam shaft to a second position spaced from the gear hub to disconnect the cam shaft from the machine drive. In this position a manually operable means in the form of a hand wheel is connected to the cam shaft so that the cam shaft may be manually rotated even though the machine drive is bypassed. Activation of the hand wheel causes a repositioning of the warp yarn harness frames and a reversal of the warp yarn sheds to provide access to the faulty pick thereby facilitating removal thereof.

It is therefore an object of the present invention to provide a means for facilitating removal of faulty picks in a fluid jet loom or in fly shuttle looms which have been converted to fluid jet looms.

It is another and more specific object of the present invention to provide a pick finder apparatus whereby an operator can manually adjust the warp yarn harness frames of fluid jet looms to reverse the warp yarn sheds, thereby exposing the faulty pick for easy removal thereof.

Other objects and a fuller understanding of the present invention will become apparent from reading the following detailed description of a peferred embodiment along with the accompanying drawings in which.

Figure 1:
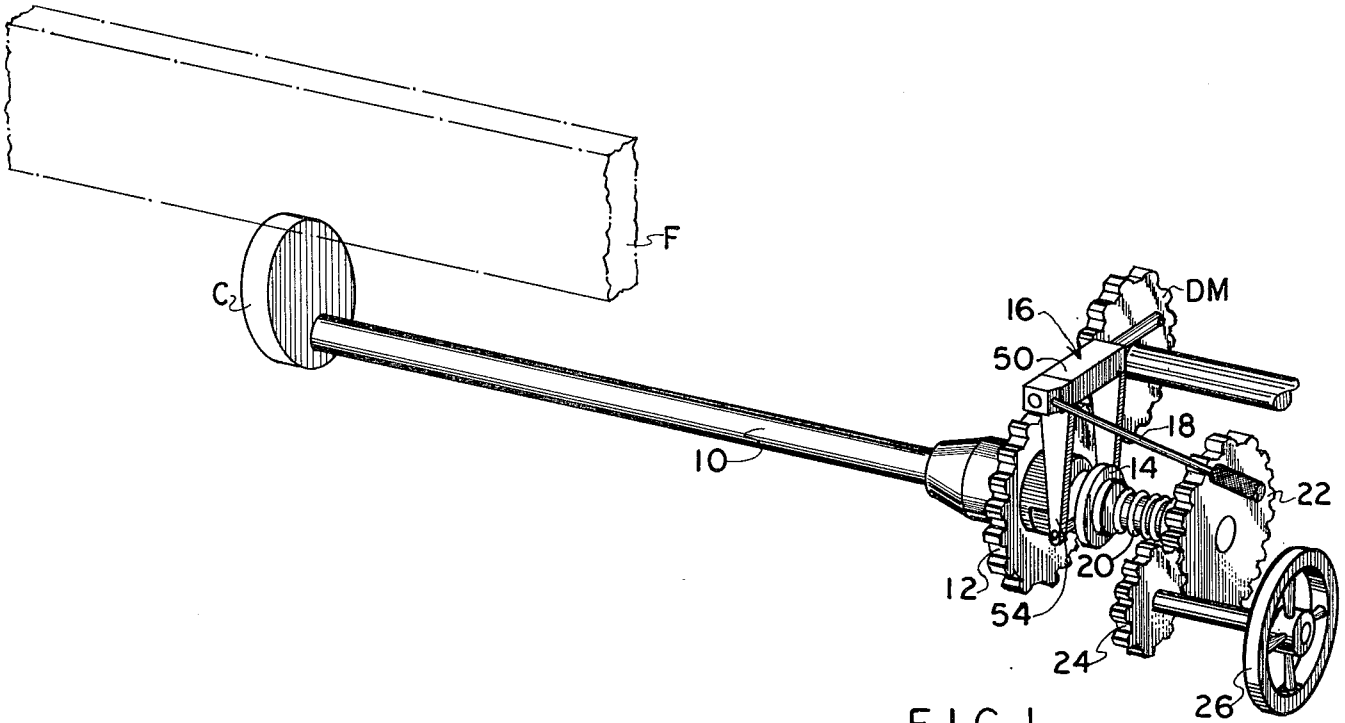
FIG. 1 is a perspective view, with parts broken away, illustrating the warp yarn harness frame reversing mechanism according to the present invention.
Figure 4:
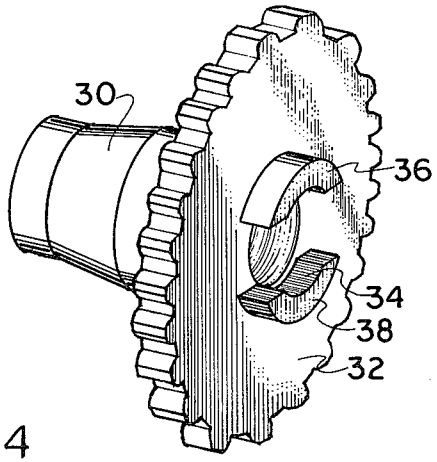
Figure 5:
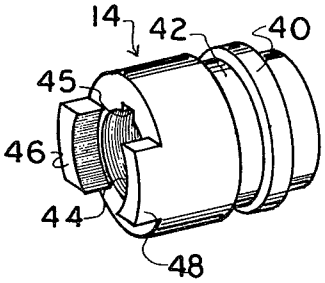

FIG. 4 is a perspective view of the gear hub member removed from the loom; and FIG. 5 is a perspective view of the second clutch member removed from the loom. cl DETAILED DESCRIPTION OF A PREFERRED EMBODIMENT Turning now to the drawings, there is illustrated in FIG. 1 a pick finder apparatus according to the present invention for fluid jet looms or for fly shuttle looms which have been converted to fluid jet looms. In general this apparatus includes a first member or gear hub 12 which is secured to the conventional cam shaft 10, which cam shaft 10 includes mounted thereon one or more cams C. In operation, cams C engage and operate the warp yarn harness frames F according to conventional known techniques. The first member or gear hub 12 is in operative engagement with the drive mechanism DM of the loom which normally imparts rotation of the cam shaft 10 in a manner that will be explained hereinafter. A second member or clutch member 14 is also mounted for axial movement on cam shaft 10. Both the gear hub 12 and the clutch member 14 include openings therein which receive cam shaft 10. While the opening in gear hub 12 provides a bearing so that there is relative rotation between gear hub 12 and cam shaft 10, the gear hub 12 is fixed axially along the cam shaft 10 so that axial movement therealong is prevented. The second member or clutch 14 is keyed to shaft 10 so that relative rotation between the clutch member 14 and cam shaft 10 is prevented. Clutch member 14 is, however, axially movable along cam shaft 10 as will be more specifically described hereinafter.

In the normal position with clutch member 14 in operative or abutting engagement with the face of gear hub 12, the drive motion of the machine is transmitted or imparted from the drive mechanism DM through the gear hub 12, through the clutch member 14, to shaft 10 thereby causing rotation thereof. A yoke 16 provides a lever mechanism for sliding clutch member 14 axially away from the face of gear hub 12 responsive to activation of lever 18. This movement overcomes the normal bias exerted against clutch member 14 by compression spring 20 to disengage clutch member 14 from gear hub 12.

Manual operation of the cam shaft 10 is then provided by means of a hand wheel 26 which, when turned by the operator, causes rotation of a gear 24. Gear 24 is in operative engagement with the periphery of the pick finder gear 22, which in turn is secured to the end of cam shaft 10. Thus, hand wheel 26 activates manual operation of cam shaft 10 bypassing the machine drive.

Turning now to FIG. 4, there is shown a perspective view of the gear hub 12 which includes a generally cylindrical body portion 30, an annular flange 32 having teeth on the periphery thereof which teeth mesh with the gear train from drive mechanism DM, an opening 34 extending through body portion 30 for receiving shaft 10 in rotatable relation thereto, and a pair of clutch teeth 36,38 on one end face thereof.

FIG. 5 is illustrative of the clutch member 14, and in this respect includes a generally tubular member 40 having a circumferential groove 42 therein and an opening 44 through which cam shaft 10 extends. A keyway 45 receives an axially extending key (not shown) extending upward from cam shaft 10 for preventing relative rotation between the clutch member 14 and the cam shaft 10. A pair of teeth or jaws 46,48 extend axially outwardly from one face of the clutch member 14 and are so shaped and arranged as to mesh between the teeth 36,38 of the gear hub 12 when urged into engagement therewith by spring 20. In such engagement, the force from the drive mechanism of the loom may be transmitted through the clutch member 14 and onto cam shaft 10 for causing rotation thereof.

Activating lever 16 (sometimes referred to as a "yoke") includes an upper, horizontally extending body member 50 mounted on a support shaft 52, which in turn is appropriately journalled to the frame of the weaving machine in any convenient manner at any convenient location. A pair of arms 54, 56 extend downwardly from the body member 50 to a position on either side of clutch 14. Pins 58 extend inwardly from arms 54,56 and are inserted within the groove 42 in such a manner that the normal rotation of the clutch member 14 is not interfered with. However, when lever arm 18 which is also secured to support shaft 52 is lifted, there is caused pivotal movement of the yoke 16 as illustrated in FIG. 3 to move the clutch member 14 axially away from the face of gear hub 12. This operation can best be seen in FIGS. 2 and 3.

Figure 2:
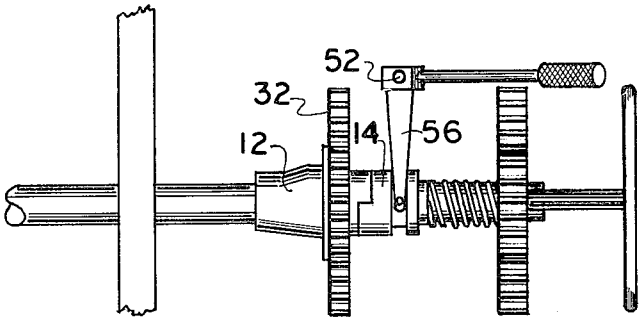
FIG. 2 is a side view illustrating the mechanism according to claim 1 with the clutch engaged.
Figure 3:
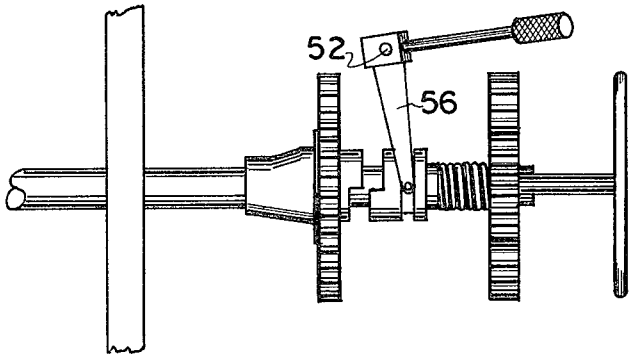
FIG. 3 is a side view of the mechanism illustrated in FIG. 1 except showing the clutch disengaged.

FIG. 2 is illustrative of the relative positioning of the pick finder apparatus during normal operation of the machine. During such times, the compression spring 20 biases clutch member 14 into engagement with the clutch face of gear hub 12. So arranged, as explained hereinabove, the drive force from drive mechanism DM is transmitted through the gear hub 12 to the clutch 14 imparting rotation of cam shaft 10. When a faulty pick occurs, the conventional stop apparatus senses the occurrence of a faulty pick and stops the loom until it is attended to by the operator. During work stoppage, of course, the drive mechanism DM is stationary, and therefore gear hub 12 is also stationary. It would be physically impossible for an operator to manually reverse the rotation of shaft 10 when operatively connected to the stationary drive mechanism of the machine. Therefore, the clutch apparatus of the present invention is activated by lifting handle 18 to free the cam shaft 10 from the drive mechanism DM.

As shown in FIG. 3, when handle 18 is lifted, the yoke 16 urges the clutch member 14 away from the face gear hub 12. The cam shaft 10 is then operatively disconnected from the drive mechanism DM. By manually rotating hand wheel 26, the cam shaft can be easily rotated to change the harness positions so that the sheds of warp yarn are opened to expose the faulty pick. It is not necessary for the operator to simultaneously lift the lever 18 during this entire operation, because as soon as the hand wheel 26 is moved enough to change the relative rotating position of clutch member 14 and gear hub 12, the jaws 46,48, 36,38 no longer mesh and the clutch member 14 cannot return to the meshed arrangement until the jaws are realigned. In the meantime, the cam shaft 10 may be easily rotatable to the proper position where the faulty pick may be removed.

While a preferred embodiment has been described in detail hereinabove, it is apparent that various changes and modifications can be made to the specific components without departing from the scope of the invention which is set forth in the claims below.

What is claimed is:

1. In a fluid jet operated weaving machine of the type which includes a rotating cam shaft for operating the warp yarn harness frames, which cam shaft is connected to the weaving machine drive mechanism, a harness motion reversing means comprising:

(a) a gear hub rotatably mounted on said cam shaft, means associated with said gear hub to prevent axial movement along said cam shaft, said gear hub further including a toothed gear annular portion engaged by said weaving machine drive mechanism and a clutch face on one end thereof;

(b) a clutch member mounted for axial movement on said cam shaft, means associated with said cam shaft and said clutch member for preventing relative rotation therebetween, said clutch member having a cooperating clutch face configuration in confronting relation to the clutch face of said gear hub, whereby when said gear hub clutch face and the cooperating clutch face of said clutch member abut each other the driving force from said drive mechanism is transmitted through said gear hub and said clutch member to said cam shaft;

(c) means for biasing said clutch member axially along sid cam shat into a first position in operable engagement with the clutch face of said gear hub;

(d) a manually operable means for urging said clutch member axially along said cam shaft into a second position disengaged from the clutch face of said gear hub;

(e) means connected to said cam shaft for manually rotating said cam shaft during times when said clutch member is in said second position to properly position said warp yarn harness frames for faulty pick removal; said means for manually rotating cam shaft comprising a pick finder gear secured to the end of said cam shaft, a cooperating gear engaging the peripheral gear portion of said pick finder gear, a shaft extending axially outwardly from said cooperating gear and terminating in a hand wheel, whereby manual movement of said hand wheel imparts a rotation to said cam shaft.

2. The harness motion reversing means according to claim 1 wherein said manually operable means for urging said clutch member from said first position to said second position comprises an activating lever including an upper body member mounted on a support shaft and a pair of spaced arms extending downwardly from said body member to a position alongside said clutch member; said clutch member including a peripheral groove and a pin extending inwardly from each arm into said groove; said pins being of such size with respect to said groove as to not interfere with normal rotation of said clutch member; said pins being responsive, however, to activation of said lever to urge said clutch member to said second position.

3. A pick finder apparatus for fluid jet weaving machines of the type in which the warp yarn harness frames are operated according to a prescribed pattern by a cam shaft which in turn is operably connected to the weaving machine drive, said apparatus comprises:

(a) clutch means for selectively disengaging said cam shaft from said machine drive; and (b) manual means operably connected to said cam shaft for bypassing said machine drive at times when said cam shaft is disengaged from said machine drive to reposition said warp yarn harness frames at such a position that faulty picks can be removed; said manual means comprising a pick finder gear secured to the end of said cam shaft, a cooperating gear engaging the peripheral gear portion of said pick finder gear, a shaft extending axially outwardly from said cooperating gear and terminating in a hand wheel, whereby manual movement of said hand wheel imparts a rotation to said cam shaft.

4. The pick finder apparatus according to claim 3 wherein said clutch means comprises:

(a) a clutch member mounted for axial movement on said cam shaft, and means associated with said cam shaft and said clutch member for preventing relative rotation therebetween;

(b) a gear hub rotatably mounted on said cam shaft, means associated with said gear hub to prevent axial movement thereof along said cam shaft, said gear hub having a toothed gear annular portion operably engaging said weaving machine drive;

(c) said clutch member and said gear hub having opposed clutch faces for transmitting rotational motion from said gear hub to said clutch member and onto said shaft;

(d) means for biasing said clutch member axially along said cam shaft into a first position in operable engagement with the clutch face of said gear hub;

(e) a manually operable means for urging said clutch member axially along said cam shaft into a second position disengaged from the clutch face of said gear hub.

* * * * *